United States Patent [19]

Geller et al.

[11] Patent Number: 4,805,546

[45] Date of Patent: Feb. 21, 1989

[54] RETRACTABLE WATER BOARD FIN

[75] Inventors: Douglas A. Geller, Arcadia; Stephen E. Schneider, Claremont; William C. Holbrook, San Gabriel, all of Calif.

[73] Assignee: Kransco Manufacturing, Inc., San Francisco, Calif.

[21] Appl. No.: 148,161

[22] Filed: Feb. 1, 1988

Related U.S. Application Data

[63] Continuation of Ser. No. 820,104, Jan. 21, 1986, abandoned.

[51] Int. Cl.[4] ..... B63B 41/00

[52] U.S. Cl. ..... 114/132; 114/39.2; 114/127; 441/74; 74/475; 74/525

[58] Field of Search ..... 114/127-132, 114/39.2, 143; 441/65, 74, 79, 70; 74/475, 525, 535; 280/43.17

[56] References Cited

U.S. PATENT DOCUMENTS

| | | | |
|---|---|---|---|
| 3,066,327 | 12/1962 | Durfey | 441/79 |
| 3,082,444 | 3/1963 | Estes | 441/70 |
| 3,087,173 | 4/1963 | Meyer | 441/79 |
| 3,287,991 | 11/1966 | Eckert | 74/525 |
| 3,516,100 | 6/1970 | Ellis | 441/79 |
| 3,902,441 | 9/1975 | Scholle | 114/132 |
| 4,398,485 | 8/1983 | Diziere | 114/32 |
| 4,493,665 | 1/1985 | Liddle | 441/79 |
| 4,566,349 | 1/1986 | Van der Loon et al. | 74/475 |

FOREIGN PATENT DOCUMENTS

| | | | |
|---|---|---|---|
| 2659297 | 3/1978 | Fed. Rep. of Germany | 114/132 |
| 2738070 | 3/1979 | Fed. Rep. of Germany | 114/132 |
| 2828859 | 1/1980 | Fed. Rep. of Germany | 441/74 |
| 3446844 | 7/1985 | Fed. Rep. of Germany | 441/79 |
| 0000993 | 1/1982 | Japan | 114/127 |
| 85789 | 5/1983 | Japan | 114/39.2 |

*Primary Examiner*—Sherman D. Basinger
*Assistant Examiner*—Paul E. Salmon
*Attorney, Agent, or Firm*—Kolisch, Hartwell & Dickinson

[57] ABSTRACT

A generally trapezoidal fin (22) is pivotally fastened to a casing which can receive the entire fin, permitting total retraction of the fin. The casing is formed with at least one notch (42) for selectively positioning the fin relative to the casing. In a preferred embodiment, the fin is operated by a lever member (26) which has a knob (50) at its distal end for use in positioning the fin (22) from above.

7 Claims, 2 Drawing Sheets

RETRACTABLE WATER BOARD FIN

This application is a continuation of application Ser. No. 07/820,104 filed Jan. 21, 1986, to be abandoned.

TECHNICAL FIELD

The present invention relates boards, and more specifically to a retractable fin which imparts stability to the water board in use and which retracts without interfering with the user.

BACKGROUND OF THE INVENTION

Water boards are similar to water skis. The water boarder is towed behind a powerful boat. The main difference, however, is that the water boarder kneels on his/her board. A strap is provided on the water board for the "boarder" to place over his/her thighs to keep the board in contact with the knees and shins of the boarder. It has been recognized that the stability of the water board can be greatly improved, under certain conditions, by the addition of two fins on the underside of the board. The fins provide control and lateral stability at high speeds. While this increase in stability is desirable for certain types of water boarding, there are other styles of water boarding wherein the fins are neither necessary nor desirable. One example of such a style would be jumping where the board and the boarder are towed across an inclined plane to gain altitude. Others would be spin-360s and side slides. The present invention provides a retractable feature for the fins.

The use of fins or skegs to impart stability is a technique known in water skiing, surfing, and sailing wherein the fin is called a keel. There are several patents which are typical of the design of water ski fins. U.S. Pat. No. 3,087,173 shows an adjustable, retractable fin positioned at the aft end of the ski. The fin is contained within a raised housing which protrudes above the plane of the ski surface. The position of the fin is controlled by two leaf springs and an s-shaped track through which a slide pin travels. U.S. Pat. No. 3,066,327 discloses a retractable stabilizer for water skis which pivots about a pin passing through the stabilizer and its housing disposed at the aft-end of the ski and above the ski surface. Latch means are provided to maintain the stabilizer in the retracted position. U.S. Pat. No. 3,082,444 describes a water ski safety skeg which is protected from damage from underwater debris and inclined ramps by its ability to automatically retract.

While the water board fin is subject to the same design criteria concerning underwater debris and ramps, etc., the water board presents a problem not present in water ski skeg design. This difference relates to the quality and quantity of user contact with the board. A water skier's contact with the water ski comprises the placement of his/her foot in a rubber binding. The remainder of the water skier's body is not intended to contact the ski. Thus, the stabilizers used on water skis are permitted to protrude above the surface of the ski without interfering with the skier. Water boards on the other hand must carefully guard against this above surface protrusion since the water boarder's knees and shins are in contact with the board surface all the way to its rear terminus. The location of the skegs at the aft end of the water board or ski results from the dynamics of the stabilizing phenomenon. This location is not subject to large degree of variation due to the dynamics of the board in motion. This invention provides a retractable fin which protrudes only minimally above the water board surface.

Therefore, it is an object of this invention to provide a retractable fin for a water board which does not interfere with the boarder's knees or shins.

It is a further object of this invention to provide a retractable fin which can be selected to be in the retracted position or in the extended position.

SUMMARY OF THE INVENTION

In a retractable fin, the improvement comprising an elongate lever member attached to the fin, a notched casing and pivot means to fasten the fin to the casing. The retractable fin is attached to the casing such that the fin does not protrude above the casing and is completely maintained within the casing. In a preferred embodiment the lever member has beveled locking means disposed along its longitudinal axis for cooperation with the notched casing and a handle at its distal end for selectively positioning the fin relative to the casing.

DETAILED DESCRIPTION OF THE DRAWINGS

DESCRIPTION OF THE PREFERRED EMBODIMENT

While the retractable fin of the present invention is described with reference to a HYDROSLIDE kneeboard (Kransco Corp., San Francisco, Calif.), it is intended that the retractable fin can be utilized in conjunction with BOOGIE Boards (Kransco Corp., San Francisco, Calif.), wherein the user lies upon the board surface, and in conjunction with surfboards, too.

Figure 1:
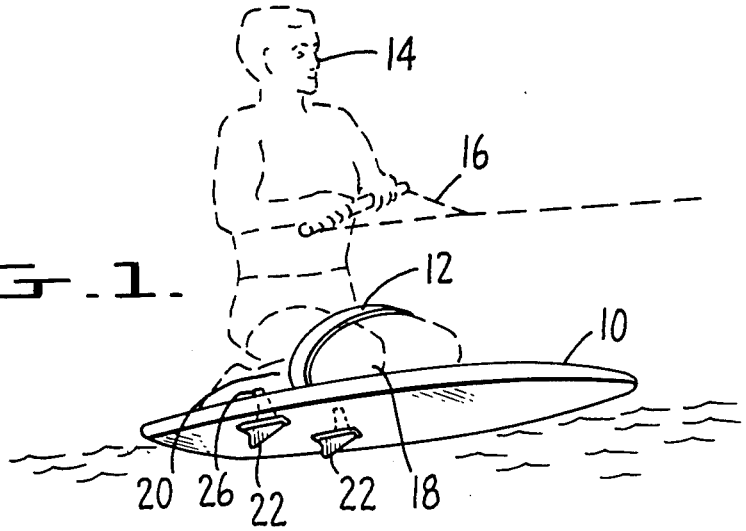
FIG. 1 is a perspective view of a water boarder and the water board showing the retractable fins of the present invention.

A water board 10 is shown in FIG. 1. A strap 12, fastened at either end to the board 10, encircles the mid-thighs of a boarder 14. The board 10 and boarder 14 are propelled through the water by holding onto a tow rope 16 which is attached at its other end to a power boat (not shown in this figure). The boarder 14 kneels upon the upper surface of the board 10 such that his knees 18 and shins 20 are in contact with the upper surface. On the underside of the board 10, identical fins 22 constructed according to the invention are shown in their extended position near the aft end of the board 10. A lever 26 is shown extending above the board 10 upper surface approximately at the boarder's ankles. This location permits the boarder 14 to adjust the position of the fins 22 while underway.

Figure 2:
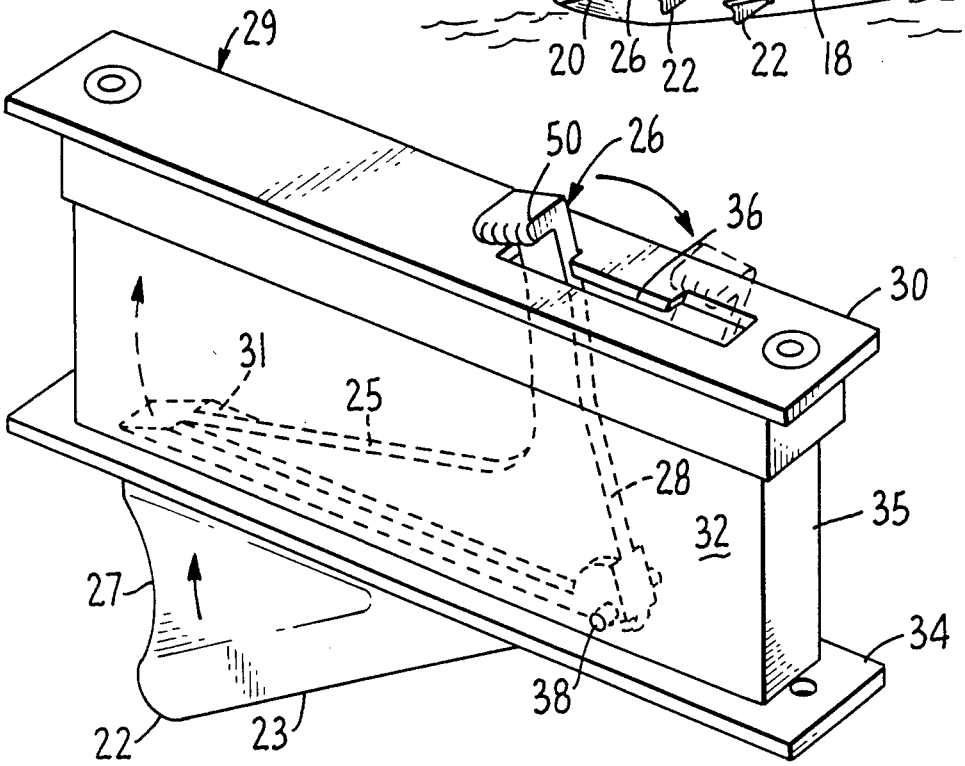
FIG. 2 is a perspective view of the retractable water board fin of the present invention.
Figure 4:
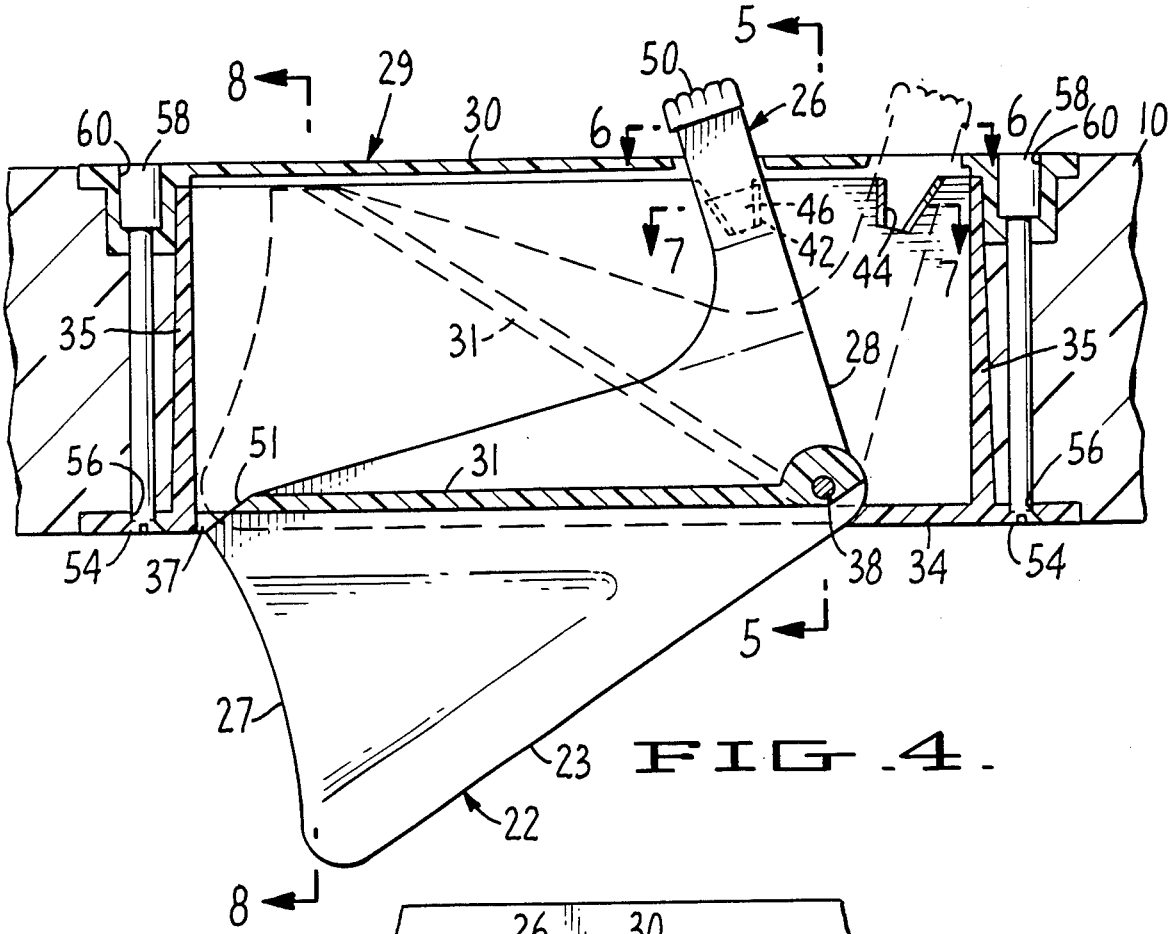
FIG. 4 is a cross sectional view of the retractable fin, shown in side elevation.

A more detailed view of the retractable fin mechanism can be seen in FIGS. 2 and 4. As there shown, the lever 26 is part of the retractable fin 22. The body of the fin 22 is generally planar and trapezoidal in shape, having two generally horizontal edges 23 and 25, and two parallel, generally vertical edges 27 and 28 and an intermediate stop collar 31. It is intended to be within the scope of this invention for the lever 26 and fin 22 to be two separate pieces fastened substantially in the manner as shown in the appended drawings in any of several fastening methods known to those skilled in the art.

The fin 22 is received in a casing 29 having a hollow body formed by a slotted top 30, side walls 32 and 33, a slotted bottom 34, and end walls 35. A slot 36 is provided in top 30 to receive the lever 26. The side and end walls of the casing define a cavity. The fin 22 is pivotally fastened within the cavity 29 by pivot pin 38 which passes through a lower corner of the fin 22, and openings in the walls 32 and 33. Movement of the lever 26 in the slot 36 forces the fin 22 to rotate about the pivot pin 38, causing the fin 22 to move between the retracted and extended positions relative to the casing 29. In the extended condition, as shown in solid lines in FIG. 4, the collar 31 comprising opposed ribs abuts against the bottom 34 to either side of the slot or fin-receiving opening, designated 37, formed therein. Portions of bottom 34 where such bounds slot 37 are referred to herein as shoulders. The fin 22 is designed such that its bottom edge 23 coincides with the plane of the bottom 34 when the fin 22 is totally retracted. This retracted position permits the board 10 to be towed across an inclined ramp without damage to the fin 22 or the casing 29. The totally retracted fin position is also desirable for several of the stunts described above (e.g., spin-360 and side slides).

The fin 22 and casing 29 are so proportioned that when retracted the fin is completely contained within the casing. (See the phantom line representation of FIG. 4.) The only member which extends above the plane of the upper section 30 is the lever 26. The cooperation of lever 26 and slot 36 must be sensitive to two different applications of force. First, the lever 26 can be manually activated by the boarder 14 who wishes to extend or to retract the fin 22. This adjustment must be relatively easy for the boarder 14 to accomplish while the board 10 is in use. Secondly, the lever 26 must move easily in the slot 36 when the fin 22 is struck from below the water line by a submerged obstacle or ramp. Thus, the lever 26 must be able to easily translate forces from above and below the pivot pin 38 without failure which could easily lead to complete destruction of the fin 22 or fracture of the lever 26.

Figure 3:
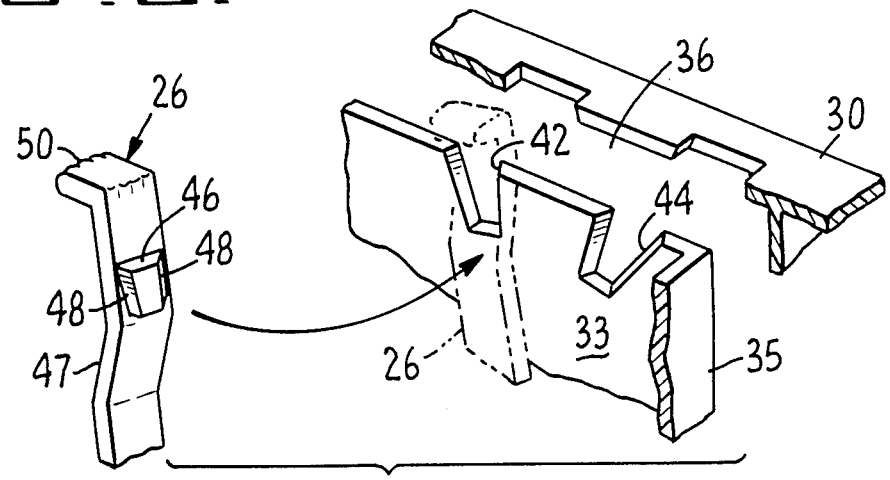
FIG. 3 is an exploded perspective view, with parts broken away, illustrating the lever member and casing notches of the retractable fin.

In the exploded view of FIG. 3, top 30 is shown removed from the walls 32, 33 and 35. The lever 26 is shown in the fin extended position and received within a notch 42 in the wall 30. A fin retracted notch 44 is formed in the wall 30 approximately 30 degrees from the notch 42, as measured about the axis of the pivot pin 38. This embodiment has two positions, extended or retracted, but it is intended to be within the scope of this invention to have any number of available positions permitting intermediate levels of fin extension. The top 30 has two positions in slot 36 which correspond to notches 42 and 44 in rear casing wall 33. Lever 26 is formed with detent protrusion 46 which is complementally engageable with the notches 42 and 44. The protrusion has beveled edges 48. A knob or handle 50 is formed on the distal end of the lever. When the lever 26 is contained within the casing 29, the protrusion 46 is selectively received within notches 42 and 44. The beveled edges 48 of the protrusion 46 make it easier for the protrusion 46 to slide and to be displaced from the notches 42 and 44. Therefore, if the fin 22 is an extended position (corresponding to notch 42), and it strikes an obstruction, the beveled edges 48 facilitate cam-like displacement of the protrusion 46 from the notch 42 and permit the fin 22 to be retracted. The lever 26 also has a bend 47 along its longitudinal axis which causes it to act as a leaf spring. At rest, the leaf-spring-lever 26 rests against the rear casing wall 33 and its corresponding notches 42 and 44. When force is applied either from below, as when the fin 22 strikes an obstruction or the like, or from above, as when the boarder 14 desires to select a position by manually applying force to the distal end of the lever 26 through the knob 50, the beveled edges 48 facilitate the movement of the lever 26 out of the notched positions and along the plane of the casing wall 33. The thickness of the protrusion 46 serves to offset the lever 26 away from the rear casing wall 33 thereby clearing the set positions in slot 36.

The cross sectional view of FIG. 4 illustrates the various positions of the fin 22 relative to the casing 29 and the geometric relationship between the fin 22 and casing 29. Casing 29 is set in the water board 10 such that its height is coincident with the thickness of the board 10. Lever 26, with knob 50, is shown in notch 42. In this position, the fin 22 is extended, with the collar 31 abuttingly engaged with the bottom 34. The retracted fin position, corresponding to notch 44, is shown in phantom lines. In the later position, the lower horizontal fin edge 23 corresponds with the plane of the bottom 34. A flattened corner 51 on the fin 22 permits it to fit fully within the casing 29.

The top 30 is removable from the side walls 32 and 33 and end walls 35 to enable the casing to be inserted into place in a slot therefor within a board. As viewed in plan, the top 30 and bottom 34 have transverse dimensions greater than that of the box defined by the side and end walls of the casing. This greater dimension provides flange surfaces which engage with the outside surfaces of a board within which the casing is received. The casing is held in place within a board by screws 54 which seat against bottom 34 and extend through openings 56 therein into threaded engagement with nuts 58 received in openings 60 in the top 30. It will be appreciated that the casing has a depth equal to or less than that of the board so that when secured in place within a board the casing does not significantly protrude therefrom.

It can also be seen in FIG. 4 that fin vertical edge 25 is slightly curved in this embodiment. This curvature contributes to the favorable dynamic properties of fin 22 and is generally unrelated to its retractable features.

Figure 5:
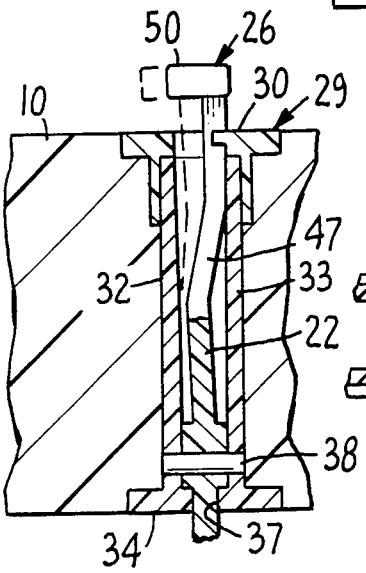
FIG. 5 is a sectional view taken along the line 5—5 in FIG. 4.

Referring now to the sectional view of FIG. 5, the leaf-spring effect of the bend 47 can be more clearly seen. The lever 26 is contained within the casing 29 defined by the side and end walls of the casing. Near the bottom 34, the pivot pin 38 is shown passing through the fin 22, and casing walls 32 and 33. The bend 47 causes the lever 26 to be flush against casing wall 30. The lever 26 is made of sufficiently pliable material such that it can be made to flex as shown by the phantom lines. This pliability makes it possible for the lever 26 to be easily moved. Polycarbonate material, such as Dow CALIBRE 330-10, or G.E. LEXAN 141, has been found suitable for fabrication of the casing and fin body components, including the lever 26.

Figure 6:
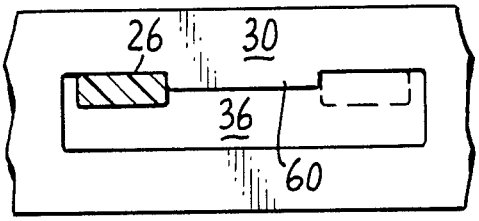
FIG. 6 is a sectional view taken along the line 6—6 in FIG. 4.

FIG. 6 shows the top of lever 26 within the slot 36 formed in the top 30. Slot 36 defines the arc through which fin 22 is permitted to rotate about the pivot pin 38. It is important that lever 26 be restricted to a certain arc of movement. Fin 22 has a maximum extended position, corresponding to the placement of lever 26 in FIG. 6, and a maximum retracted position which corresponds to the other position represented by the dashed lines. An enlarged locking boss 60 is formed integrally with the top 30 and extends into the slot 36 to assist in releasably securing the lever at the positions of maximum retraction and extension of the fin.

Figure 7:
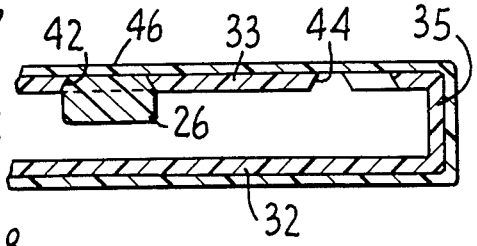
FIG. 7 is a sectional view taken along the line 7—7 in FIG. 4.
Figure 8:
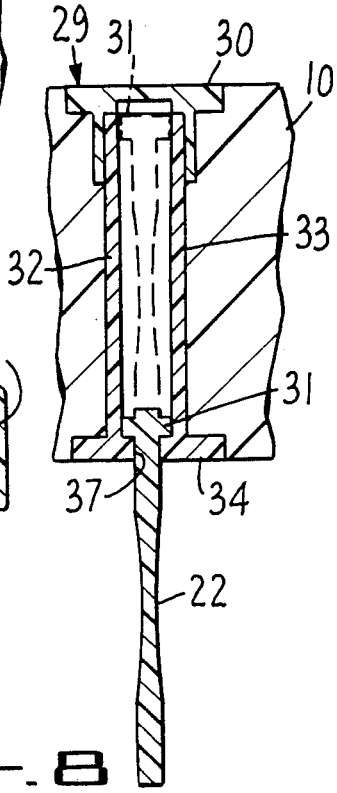
FIG. 8 is a sectional view taken along the line 8—8 in FIG. 4.

FIG. 7 shows how, despite the well defined positions represented by the slot 36, the lever 26 can be moved by the application of force to the bottom of the fin, without the application of force at the top end of lever 26. The section of FIG. 7 is taken below the plane of the top 30 and illustrates the notches 42 and 44 and the locking member 46. As there seen, the beveled edges of the protrusion 46 permit the lever 26 to be easily moved out of the notch 42. FIG. 7 shows how the top of lever 26 is set back from the locking protrusion 46. This offset, of a distance equivalent to the thickness of the locking member 46, allows the top of lever 26 to be lifted out of the slot 36 position corresponding to notch 42 when a retracting force is applied from below to the fin 22.

While the subject invention has been described with reference to a preferred embodiment, it will be apparent that other changes and modifications could be made by one skilled in the art without varying from the scope or spirit of the appended claims.

We claim:

1. The combination of a retractable fin assembly mounted within a water board, the water board having a top and a bottom and a given depth, said assembly comprising:

a casing including a hollow body having a cavity defined therein and said body having a depth equal to or less than that of the board, said casing body having a top and a bottom and there being a fin-receiving opening defined through the bottom of the casing;

said casing further having first and second flanges secured to the top and bottom of said casing body extending laterally of said casing body and engaging the top and bottom of the board with the board sandwiched between said flanges, said casing including one section having said first flange and another section separable from the one section having said second flange and the assembly further including detachable fastener means securing said one and said other sections together, removal of said fastener means and separation of the sections permitting the casing to be extended through the board, a fin receiving within the cavity, said fin being so proportioned relative to the casing that it may be fully contained therein;

means mounting the fin within the casing for select movement between a first position fully contained within the casing and a second position extending from the fin-receiving opening of the casing; and detent means to selectively lock the fin body in said respective first and second positions.

2. A fin assembly according to claim 1, further comprising lever means secured to said fin to manually move said fin between said first and second positions.

3. The combination of claim 1, wherein said fin has rib means projecting laterally thereof, and said rib means moves against and engages said bottom of the casing body with said fin in its said second position.

4. The combination of claim 1, wherein the casing body has side walls extending between the top an bottom of the casing body and wherein the means mounting said fin within the casing body comprises pivot pin means extending from said fin and mounted on said side walls of the casing body.

5. In combination with a water board having a top and a bottom and a given depth, means defining a fin-receiving cavity within said board extending between the top and bottom of the board, said means including a casing section having a bottom portion disposed against the bottom of the board and said bottom portion forming the bottom of said cavity, a fin received within said cavity, said fin being so proportioned relative to the cavity that it may be essentially fully contained therein, an opening in said bottom portion of the casing section bounded by a shoulder and said opening being shaped to permit movement of the fin therethrough, rib means integral with said fin disposed within said cavity, pivot means pivotally mounting said fin within the cavity for movement of the fin between a first position essentially fully contained within the cavity and a second position wherein the fin extends through said opening to protrude below the base of the board, said rib means being positioned on said fin so that on said fin being shifted to its said second position, the rib means engages said shoulder to limit further movement of the fin and stabilize the fin in its second position.

6. The combination of claim 5, wherein said casing section is separable from the bottom of said board and which further includes detachable fastener means mounting the casing section in place, and wherein said casing section includes upstanding wall portions extending upwardly from said bottom portion and said pivot means pivotally mounts said fin on said upstanding wall portions.

7. In combination with a water board having a top and a bottom and a given depth, means defining a fin-receiving cavity within said board extending between the top and bottom of the board, said means including a casing section having a bottom portion disposed against the bottom of the board and which forms the bottom of said cavity, detachable fastener means detachably securing said casing section to the board accessible from the bottom of the board, a fin received within said cavity so proportioned relative to the cavity that it may be essentially fully contained therein, an opening in said bottom portion of the casing section shaped to permit movement therethrough of the fin, said casing section including upstanding wall portions extending upwardly from said bottom portion, and pivot means pivotally mounting said fin on said upstanding wall portions of said casing section, the pivot means accommodating movement of the fin between a first position wherein such is essentially fully contained within the cavity and a second position wherein such extends through said opening and protrudes from the bottom of the board.

* * * * *